US010134535B2

(12) United States Patent
Weber et al.

(10) Patent No.: US 10,134,535 B2
(45) Date of Patent: Nov. 20, 2018

(54) DRY TRANSFORMER LOAD SWITCH

(71) Applicant: ABB Schweiz AG, Baden (CH)

(72) Inventors: Benjamin Weber, Winterberg (DE); Jens Tepper, Brilon (DE); Martin Carlen, Niederrohrdorf (CH)

(73) Assignee: ABB Schweiz AG, Baden (CH)

( * ) Notice: Subject to any disclaimer, the term of this patent is extended or adjusted under 35 U.S.C. 154(b) by 295 days.

(21) Appl. No.: 15/281,113

(22) Filed: Sep. 30, 2016

(65) Prior Publication Data

US 2017/0018376 A1 Jan. 19, 2017

Related U.S. Application Data

(63) Continuation of application No. PCT/EP2015/054335, filed on Mar. 3, 2015.

(30) Foreign Application Priority Data

Mar. 31, 2014 (EP) ..... 14001201

(51) Int. Cl.

| | |
|---|---|
| ***H01F 27/29*** | (2006.01) |
| ***H01H 9/00*** | (2006.01) |
| ***H01F 29/02*** | (2006.01) |

(52) U.S. Cl.
CPC ..... *H01H 9/0016* (2013.01); *H01F 27/29* (2013.01); *H01F 29/025* (2013.01); *H01H 2201/01* (2013.01)

(58) Field of Classification Search
CPC ..... H01F 27/00–27/36; H01F 21/00–21/08
USPC ..... 336/65, 83, 130–138, 155–165, 90
See application file for complete search history.

(56) References Cited

FOREIGN PATENT DOCUMENTS

| | | | |
|---|---|---|---|
| DE | 1638570 | A1 | 3/1971 |
| DE | 2449004 | A1 | 4/1976 |
| DE | 3000733 | A1 | 7/1980 |

*Primary Examiner* — Tuyen Nguyen
(74) *Attorney, Agent, or Firm* — Leydig, Voit & Mayer, Ltd.

(57) ABSTRACT

A dry transformer load switch, and transformer having such switch, has a hollow insulation cylinder extending longitudinally about a virtual center axis and has a plurality of connection contacts arranged along the inner circumference thereof, and a radially oriented main contact arranged in the interior of the hollow insulation cylinder so as to be rotatable about the center axis and which, with a corresponding rotary movement, can be optionally electrically connected by the radially outer end thereof to one of the connection contacts. In a hollow-cylindrical space about the center axis that is defined by the radially inner and outer end of the main contact, there is a barrier shield, which can be rotated together with the main contact about the axis.

17 Claims, 2 Drawing Sheets

DRY TRANSFORMER LOAD SWITCH

CROSS-REFERENCE TO RELATED APPLICATIONS

This application is a bypass continuation of International Application No. PCT/EP2015/054335, filed on Mar. 3, 2015, and claims benefit to European Patent Application No. 14 001 201.4, filed on Mar. 31, 2014, the entire disclosure of each of which is hereby incorporated by reference herein. The International Application was published in German on Oct. 8, 2015, as WO 2015/150005 A1 under PCT Article 21(2).

FIELD

The invention relates to a dry transformer load switch.

BACKGROUND

It is generally known that transformers are used in energy distribution networks in order to couple power supply units having different voltage levels. Oil-immersed transformers are usually used at relatively high voltage levels, such as, for example, 110 kV/380 kV, whereas, at voltage levels lower than this, for example, 30 kV, 72.5 kV and, occasionally even 110 kV, dry transformers or gas-filled transformers are common.

Oil-immersed transformers often comprise so-called load switches, by means of which, under load current, it is possible to switch between different taps of the transformer winding, and so the voltage in the network can be regulated within wide limits by adjusting the transformation ratio of the transformer. A load switch typically comprises multiple connection contacts, which are arranged along a track and are connected to different taps of a transformer winding. A main contact is mechanically moveable along the track and, as a result, can be alternatively connected to one of the taps. The taps are usually arranged along a circular track, and so the desired taps are contacted by means of a rotary movement of the main contact.

In the case of oil-immersed transformers, load switches of this kind are located in an oil-filled region of the transformer tank which, for the sake of cleanliness, is separated from the region in which the transformer is disposed. Due to the arrangement of such a load interruptor in oil, as the insulating medium, said load interruptor can be designed to be substantially smaller than is possible with an arrangement in air.

There is an increasing demand for a possibility for adjusting the transformation ratio of dry transformers under load for relatively low voltage levels as well, for the sake of improved controllability. In the case of dry transformers, the use of oil is intentionally dispensed with, however, and so a different design is required as compared to oil-immersed transformers, in particular with regard to cooling and insulation.

A disadvantage thereof, in the case of dry transformer load switches, is that the elimination of oil, as the insulation medium, results in a substantially increased risk of electric arcing and that a dry transformer load switch must be designed to be sufficiently large in order to reduce such a risk.

SUMMARY

An aspect of the invention provides a.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
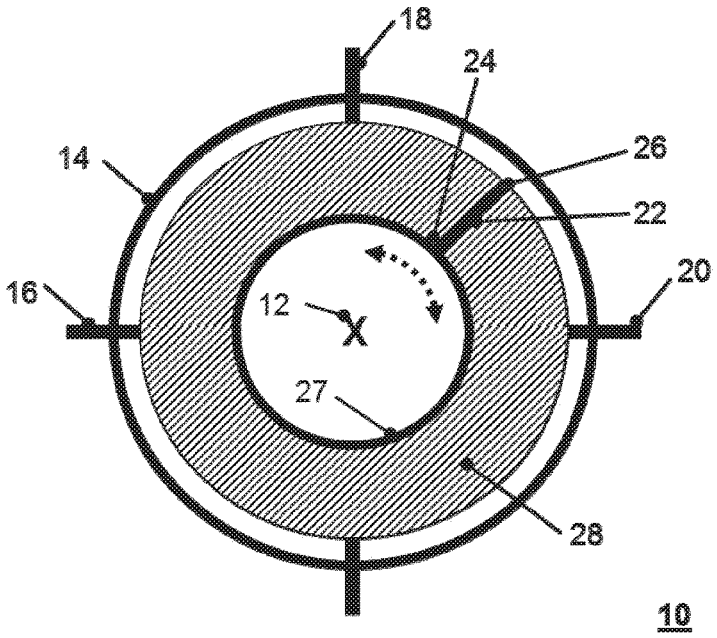
FIG. 1 shows a first dry transformer load switch, as an example.

Proceeding from this background, a problem addressed by the invention is that of providing a compact dry transformer load switch having improved insulation performance. Another problem addressed by the invention is that of providing a corresponding dry transformer.

This problem is solved by a dry transformer load switch of the type mentioned at the outset. This dry transformer load switch is characterized in that, in a hollow cylindrical space about the central axis, which is defined by the radially inner and outer ends of the main contact, there is provided a barrier shield which can be rotated together with the main contact about the central axis.

An aspect of the invention relates to a dry transformer load switch comprising a hollow insulation cylinder which extends longitudinally about a virtual central axis and has a plurality of connection contacts arranged along the inner circumference thereof, and a radially oriented main contact which is arranged in the interior of the hollow insulation cylinder so as to be rotatable about the central axis and which, by means of a corresponding rotary movement, can be optionally electrically connected via the radially outer end thereof to one of the connection contacts.

A basic idea of the invention is to provide a barrier shield which can be rotated together with the main contact in order to thereby improve the electric strength. In the case of load interruptors, the space between the connection contacts located radially outwardly on the hollow insulation cylinder and the main contact is the most insulation-critical region. A fixed barrier shield cannot be included, however, because this hollow cylindrical space about the central axis must remain available for a circulating movement by the main contact. The introduction of a barrier shield which can be rotated together with the main contact makes it possible to utilize this hollow cylindrical space about the central axis both for a movement of the main contact and for the inclusion of a barrier shield. The insulation strength of a dry transformer load switch according to the invention is advantageously increased as a result.

According to a particularly preferred embodiment of the dry transformer load switch according to the invention, the barrier shield comprises a shield element having the shape of a hollow cylinder or a hollow cylinder segment. A hollow cylindrical shield element is particularly suited for being part of a barrier shield in the likewise hollow cylindrical space about the central axis. In the region of the main contact, the barrier shield is preferably provided with an opening in order to avoid direct contact with the voltage-carrying main contact. A shortening of the creepage path, which is disadvantageous with respect to insulation performance, is thereby ruled out.

According to a further variant of the dry transformer load switch according to the invention, the barrier shield comprises at least two shield elements, which have the shape of a hollow cylinder or a hollow cylinder segment and are arranged radially over one another. As a result of a double-wall design of this kind, the voltage strength is advantageously increased further.

According to a further variant of the invention, a radially oriented inner lamella, which extends preferably along the central axis, is provided on at least one shield element having the shape of a hollow cylinder or a hollow cylinder segment. As a result, the length of possible creepage paths, the course of which is dependent upon the particular boundary conditions that exist, is advantageously lengthened and the insulation capability of the dry transformer load switch according to the invention is further increased.

In order to avoid a mechanical collision of an inner lamella of this kind with one of the outer contacts which typically extend into the interior space, it is necessary in the case of inner lamellae made from a solid material that said lamellae not extend out of the hollow cylindrical space about the central axis.

According to a further embodiment of the dry transformer load switch according to the invention, however, the at least one radially oriented inner lamella extends out of the hollow cylindrical space about the axis of rotation. Said inner lamella is produced from an elastic material, however, such as silicone rubber, for example. In the event of a collision of the lamella with a connecting contact, a temporary deformation of the lamella and a rotary movement of the main contact is therefore still possible.

According to an alternative embodiment of the dry transformer load switch according to the invention, the at least one radially oriented inner lamella also extends out of the hollow cylindrical space about the axis of rotation. Means are provided, however, for displacing the inner lamella radially inwardly at least for the duration of one rotary movement of the barrier shield. Therefore, when the barrier shield is at a standstill, a creepage path extension in the form of the extended lamella is advantageously active, wherein, however, retracting the lamella allows for a collision-free rotary movement of the main contact together with the barrier shield.

According to a further variant of the invention, a radially oriented outer lamella is provided on the inner circumference of the hollow insulation cylinder, which lamella extends into the interior space of said cylinder. As a result, the creepage path between adjacent outer contacts is advantageously increased and said outer contacts can be arranged closer to one another in a space-saving manner.

For the case, in particular, in which the outer lamella extending into the interior space also extends into the hollow cylindrical space about the central axis, it is provided according to the invention that the at least one radially oriented outer lamella is produced from an elastic material. As a result, in the event of a collision with the main contact, the particular outer lamella undergoes a temporary deformation.

In a corresponding manner, according to the invention, at least one lamella is also optionally provided on the radial outer surface of the hollow insulation cylinder between protruding connection contacts, the purpose of which lamella corresponds to that of the aforementioned inwardly extending outer lamella. Preferably, corresponding lamellae are provided both on the inside and on the outside of the hollow insulation cylinder.

According to a further embodiment of the dry transformer load switch according to the invention, at least one connection contact extending radially into the interior space of the hollow insulation cylinder is enclosed by a hollow cylindrical barrier. The creepage path to adjacent connection contacts is therefore advantageously lengthened again.

According to a further particularly preferred variant of the invention, the barrier shield is held by disk elements, which are rotatable about the central axis and which are provided at the axial end regions of the hollow insulation cylinder. In order to lengthen possible creepage paths, direct contact of the barrier shield with the main contact should be avoided, according to the invention. This can be achieved, in particular for the insulation-relevant region in the hollow cylindrical space about the central axis, by means of disk-like carrier elements, which are made from an insulation material and are preferably provided in the region of the axial ends of the hollow insulation cylinder. The connection of a hollow cylinder segment-like segment, which is produced, for example, from a glass fiber-reinforced plastic plate, to a disk element takes place, for example, by means of an annular groove, which is milled into the disk element. A sufficient spacing from the hollow insulation cylinder and the disk element or the barrier shield connected thereto must be ensured.

According to a further variant of the dry transformer load switch according to the invention, said switch is hermetically encapsulated and is filled with an insulating gas. An insulating gas such as, for example, SF6 advantageously increases the voltage strength.

The problem addressed by the invention is also solved by a dry transformer comprising a transformer core having at least one winding and one load switch, wherein the load switch is a dry transformer load switch according to the invention. The advantages, according to the invention, of a greater insulation strength or a smaller size were already explained for the dry transformer load switch and can also be transferred to a dry transformer comprising a dry transformer load switch.

Further advantageous design options are found in the further dependent claims.

The invention, further embodiments, and further advantages are described in greater detail on the basis of the exemplary embodiments illustrated in the drawings.

FIG. 1 shows a sectional view of a first dry transformer load switch 10, as an example. A tubular hollow insulation cylinder 14 made from an insulating material, for example, from a glass fiber/epoxy resin composite material, is arranged about a virtual central axis 12. Multiple connection contacts 14, 16, 18 are routed, in a common plane perpendicular to the central axis 12, through the walls of the hollow insulation cylinder 14, into the interior thereof and extend into said interior.

A hollow cylindrical rotating body 27 having a main contact 22 extending radially away from the outer surface of said body is rotatably arranged about the central axis 12 as well. By means of a corresponding rotary movement, the radially outer end 26 of the main contact 22 can be alternatively connected to one of the connection contacts 14, 16, 18. A hollow cylindrical space 28 is formed about the central axis 12 by the radially inner 24 and outer 26 ends of the main contact 22, through which space the main contact passes during a rotary movement.

Figure 2:
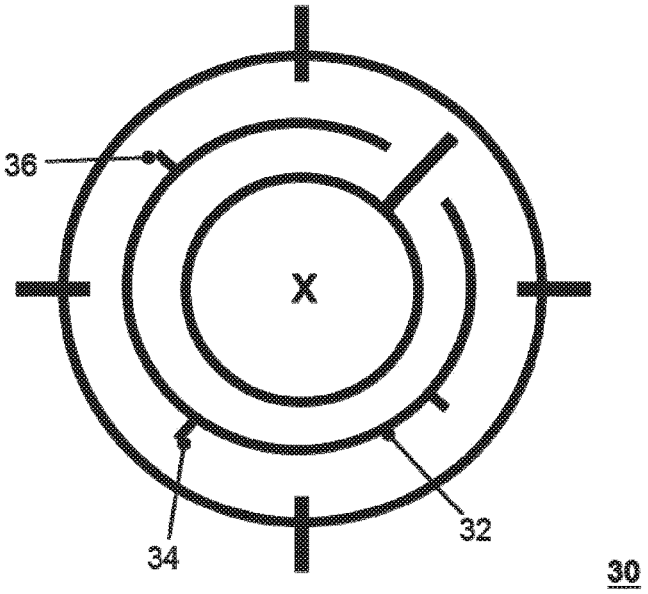
FIG. 2 shows a second dry transformer load switch, as an example.

FIG. 2 shows a sectional view of a second dry transformer load switch 30, as an example. This is similar to the dry transformer load switch shown previously in FIG. 1. In this example, however, a barrier shield, which can be rotated together with the main contact and which comprises a hollow cylinder segment-shaped shield element 32 and radially oriented inner lamellae 34, 36 connected to said shield, are shown. The electric insulation capability of the dry transformer load switch is advantageously increased as a result.

Figure 3:
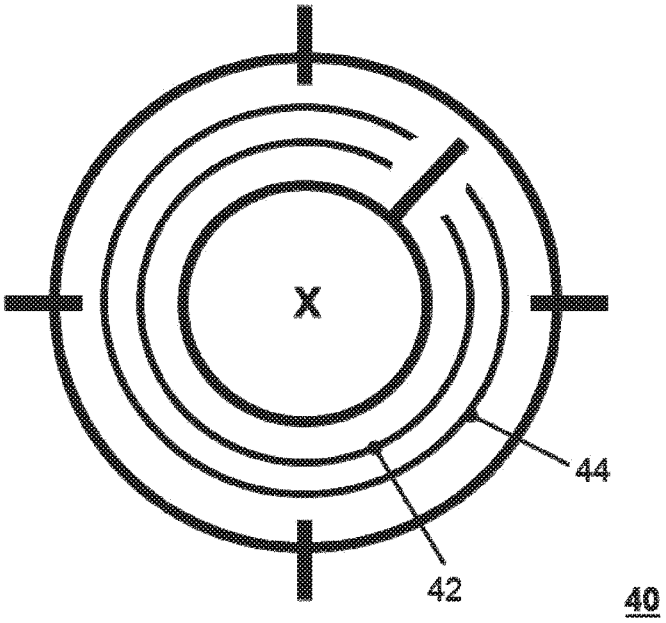
FIG. 3 shows a third dry transformer load switch, as an example.

FIG. 3 shows a sectional view of a third dry transformer load switch 40, as an example. In this case, the rotatable barrier shield comprises two radially adjacent, hollow cylinder segment-shaped shield elements 42, 44, by way of which the dielectric strength of the barrier shield is advantageously increased.

Figure 4:
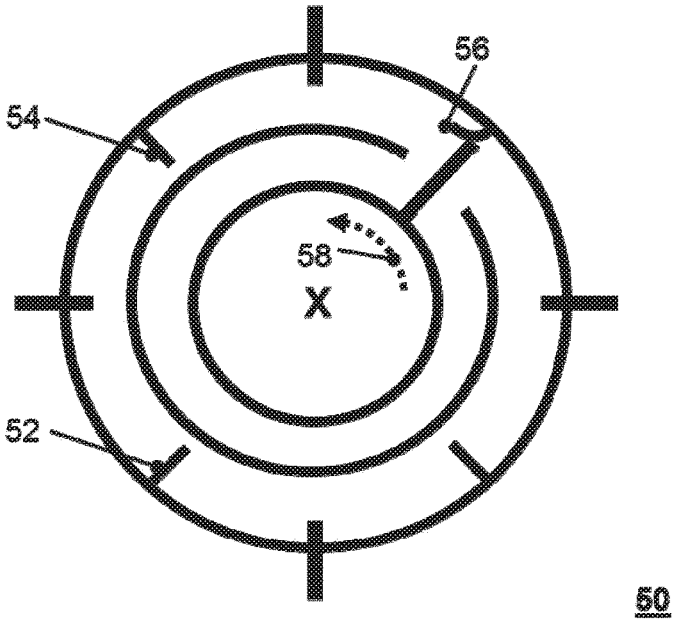
FIG. 4 shows a fourth dry transformer load switch, as an example.

FIG. 4 shows a sectional view of a fourth dry transformer load switch 50, as an example. In deviation from the previous figures, radially oriented outer lamellae 52, 54, 56 are arranged on the inner circumference of the hollow insulation cylinder of the dry transformer load switch, which lamellae extend into the interior space of the hollow insulation cylinder. Due to an occurring rotary movement, which is indicated by the arrow having reference number 58, the third outer lamella 56 has collided with the main contact. Since the outer lamellae in this case are produced from elastic silicone rubber, the collision results in a temporary deformation of the third outer lamella 56.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B, and C" should be interpreted as one or more of a group of elements consisting of A, B, and C, and should not be interpreted as requiring at least one of each of the listed elements A, B, and C, regardless of whether A, B, and C are related as categories or otherwise. Moreover, the recitation of "A, B, and/or C" or "at least one of A, B, or C" should be interpreted as including any singular entity from the listed elements, e.g., A, any subset from the listed elements, e.g., A and B, or the entire list of elements A, B, and C.

LIST OF REFERENCE NUMBERS

10 first dry transformer load switch, as an example
12 virtual central axis
14 hollow insulation cylinder
16 first connection contact
18 second connection contact
20 third connection contact
22 main contact
24 radially inner end of the main contact
26 radially outer end of the main contact
27 rotating body
28 hollow cylindrical space about the central axis
30 second dry transformer load switch, as an example
32 hollow cylinder segment-shaped shield element
34 first radially oriented inner lamella
36 second radially oriented inner lamella
40 third dry transformer load switch, as an example
42 radially inner hollow cylinder segment-shaped shield element
44 radially outer hollow cylinder segment-shaped shield element
50 fourth dry transformer load switch, as an example
52 first radially oriented outer lamella
54 second radially oriented outer lamella
56 third radially oriented outer lamella in the bent state
58 direction of rotation

The invention claimed is:

1. A dry transformer load switch, comprising a hollow insulation cylinder which extends longitudinally about a virtual central axis, the hollow insulation cylinder including a plurality of connection contacts arranged along an inner circumference of the hollow insulation cylinder;

a hollow cylindrical rotating body, which is arranged in an interior of the hollow insulation cylinder so as to be rotatable about the virtual central axis, the hollow cylindrical rotating body including a radially oriented main contact, the radially oriented main contact extending radially from an outer surface of the hollow cylindrical rotating body, and the radially oriented main contact, using a corresponding rotary movement, being configured to be alternatively electrically connectable via a radially outer end of the radially oriented main contact to one of the connection contacts; and a barrier shield, provided in a hollow cylindrical space about a further central axis, the further central axis being defined by a radially inner end and the radially outer end of the radially oriented main contact, wherein the barrier shield is in the form of a hollow cylindrical shield element, which can be rotated together with the radially oriented main contact about the virtual central axis, and wherein the barrier shield includes an opening in a region of the radially oriented main contact.

2. The switch of claim 1, wherein the barrier shield includes a first shield element and a second shield element, wherein the shield elements are hollow cylindrical-shaped, arranged radially over one another.

3. The switch of claim 1, further comprising:

a radially oriented inner lamella, provided on at least one shield element, which is hollow cylindrical-shaped.

4. The switch of claim 3, wherein the radially oriented inner lamella extends out of the hollow cylindrical space about the virtual central axis of rotation and is made from an elastic material.

5. The switch of claim 3, wherein the radially oriented inner lamella extends out of the hollow cylindrical space about the virtual central axis of rotation, and wherein the switch further comprises a device configured to displace the inner lamella radially inwardly at least for a duration of one rotary movement of the barrier shield.

6. The switch of claim 1, further comprising:

a radially oriented outer lamella, provided on the inner circumference of the hollow insulation cylinder, wherein the radially outer oriented lamella extends into an interior space of the hollow insulation cylinder.

7. The switch of claim 6, wherein the radially oriented outer lamella is produced from an elastic material.

8. The switch of claim 1, further comprising:

a lamella, provided at least on a radial outer surface of the hollow insulation cylinder between protruding connection contacts.

9. The switch of claim 1, comprising:

a hollow cylindrical barrier, wherein at least one connection contact, which extends radially into an interior space of the hollow insulation cylinder, is enclosed by the hollow cylindrical barrier.

10. The switch of claim 1, further comprising:

disk elements, provided at axial ends of the hollow insulation cylinder, wherein the barrier shield is held by the disk elements, wherein the disk elements are rotatable about the virtual central axis.

11. The switch of claim 1, which is hermetically encapsulated and is filled with an insulating gas.

12. A dry transformer, comprising:

a transformer core including a winding and the dry transformer load switch of claim 1.

13. The switch of claim 1, further comprising:

two or more radially oriented inner lamella, provided on at least one shield element, which is hollow cylindrical-shaped.

14. The switch of claim 13, wherein the radially oriented inner lamella extend out of the hollow cylindrical space about the virtual central axis of rotation, wherein the radially oriented inner lamella include elastic material.

15. The switch of claim 13, wherein the radially oriented inner lamella extend out of the hollow cylindrical space about the virtual central axis of rotation, and wherein the switch further comprises a device configured to displace the inner lamella radially inwardly at least for a duration of one rotary movement of the barrier shield.

16. The switch of claim 1, further comprising:

two or more radially oriented outer lamella, provided on the inner circumference of the hollow insulation cylinder, wherein the radially outer oriented lamella extend into an interior space of the hollow insulation cylinder.

17. The switch of claim 16, wherein the radially oriented outer lamella include an elastic material.

* * * * *